US012606928B2

(12) United States Patent
McHugh et al.

(10) Patent No.: US 12,606,928 B2
(45) Date of Patent: Apr. 21, 2026

(54) ELECTROPLATING SYSTEMS AND METHODS WITH INCREASED METAL ION CONCENTRATIONS

(71) Applicant: Applied Materials, Inc., Santa Clara, CA (US)

(72) Inventors: Paul R. McHugh, Kalispell, MT (US); Gregory J. Wilson, Kalispell, MT (US); Kwan Wook Roh, Kalispell, MT (US); Kyle M. Hanson, Kalispell, MT (US); Forrest G. Reinhart, Kalispell, MT (US); David J. Reis, Kalispell, MT (US); James E. Brown, Kalispell, MT (US); Nolan L. Zimmerman, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 425 days.

(21) Appl. No.: 18/129,999

(22) Filed: Apr. 3, 2023

(65) Prior Publication Data

US 2023/0313405 A1 Oct. 5, 2023

Related U.S. Application Data

(60) Provisional application No. 63/327,268, filed on Apr. 4, 2022.

(51) Int. Cl.
*C25D 17/00* (2006.01)
*C25D 3/38* (2006.01)
(Continued)

(52) U.S. Cl.
CPC ..... *C25D 17/002* (2013.01); *C25D 3/38* (2013.01); *C25D 21/02* (2013.01); *C25D 21/04* (2013.01); *C25D 21/14* (2013.01); *C25D 21/18* (2013.01)

(58) Field of Classification Search
CPC ..... C25D 121/18; C25D 21/14; C25D 21/12
See application file for complete search history.

(56) References Cited

U.S. PATENT DOCUMENTS 8,128,791 B1 3/2012 Buckalew et al.
9,637,836 B2 * 5/2017 Papapanayiotou ..... C25D 7/12
(Continued)

FOREIGN PATENT DOCUMENTS

EP 1644557 B1 11/2010
JP 7041795 B1 3/2022
(Continued)

OTHER PUBLICATIONS

Application No. PCT/US2023/017388 , International Search Report and Written Opinion, Mailed on Jul. 24, 2023, 12 pages.

*Primary Examiner* — Brian W Cohen
(74) *Attorney, Agent, or Firm* — Kilpatrick Townsend & Stockton LLP

(57) ABSTRACT

Embodiments of the present technology include electroplating methods that include providing a first portion of an electrolyte feedstock to a first compartment of an electrochemical cell. The first portion of an electrolyte feedstock may be characterized by an initial metal ion concentration and an initial acid concentration. The methods may include providing a second portion of an electrolyte feedstock to a second compartment of the electrochemical cell. The second compartment and first compartment may be separated by a first membrane. The methods may include providing an acidic solution to a third compartment of the electrochemical cell. The third compartment and second compartment may be separated by a second membrane. The acidic solution may be characterized by an initial acid concentration. The methods may include applying a current to an anode of the electrochemical cell. The anode of the electrochemical cell
(Continued)

may be disposed proximate the first compartment and across from the first membrane.

21 Claims, 3 Drawing Sheets

(51) Int. Cl.

| | |
|---|---|
| ***C25D 21/02*** | (2006.01) |
| ***C25D 21/04*** | (2006.01) |
| ***C25D 21/14*** | (2006.01) |
| ***C25D 21/18*** | (2006.01) |

(56) References Cited

U.S. PATENT DOCUMENTS

| | | | | |
|---|---|---|---|---|
| 10,011,919 | B2 | 7/2018 | Mayer et al. | |
| 2017/0016137 | A1* | 1/2017 | Wilson | C25D 17/06 |

FOREIGN PATENT DOCUMENTS

| | | | |
|---|---|---|---|
| TW | 201233852 | A | 8/2012 |
| TW | 201718953 | A | 6/2017 |

* cited by examiner

ELECTROPLATING SYSTEMS AND METHODS WITH INCREASED METAL ION CONCENTRATIONS

CROSS-REFERENCE TO RELATED APPLICATIONS

This application claims the benefit of, and priority to U.S. Provisional Application Ser. No. 63/327,268, filed Apr. 4, 2022, which is hereby incorporated by reference in its entirety for all purposes.

TECHNICAL FIELD

The present technology relates to electroplating operations in semiconductor processing. More specifically, the present technology relates to systems and methods that perform concentration and replenishment for electroplating systems.

BACKGROUND

Integrated circuits are made possible by processes which produce intricately patterned material layers on substrate surfaces. After formation, etching, and other processing on a substrate, metal or other conductive materials are often deposited or formed to provide the electrical connections between components. Because this metallization may be performed after many manufacturing operations, problems occurring during the metallization may create expensive waste substrates or wafers.

Electroplating is performed in an electroplating chamber with the device side of the wafer in a bath of liquid electrolyte, and with electrical contacts on a contact ring touching a conductive layer on the wafer surface. Electrical current is passed through the electrolyte and the conductive layer. Metal ions in the electrolyte plate out onto the wafer, creating a metal layer on the wafer. Electroplating chambers typically have consumable anodes, which are beneficial for bath stability and cost of ownership. For example, it is common to use copper consumable anodes when plating copper. The copper ions taken out of the plating bath are replenished by the copper removed from the anodes, thereby maintaining the metal concentration in the plating bath. Although effective at replacing plated metal ions, using consumable anodes requires a relatively complex and costly design to allow the consumable anodes to be replaced. Even more complexity is added when consumable anodes are combined with a membrane to avoid degrading the electrolyte, or oxidizing the consumable anodes during idle state operation.

Thus, there is a need for improved systems and methods that can be used to produce high quality devices and structures while protecting both the substrate and the plating baths. These and other needs are addressed by the present technology.

SUMMARY

Embodiments of the present technology include electroplating methods that include providing a first portion of an electrolyte feedstock to a first compartment of an electrochemical cell. The first portion of the electrolyte feedstock may be characterized by an initial concentration of a metal ion and an initial acid concentration. The methods may include providing a second portion of the electrolyte feedstock to a second compartment of the electrochemical cell.

The second portion of the electrolyte feedstock may be characterized by an initial metal ion concertation. The second compartment and first compartment may be separated by a first membrane. The methods may include providing an acidic solution to a third compartment of the electrochemical cell. The third compartment and second compartment may be separated by a second membrane. The acidic solution may be characterized by an initial acid concentration. The methods may include applying a current to an anode of the electrochemical cell. The anode of the electrochemical cell may be disposed proximate the first compartment and across from the first membrane.

In some embodiments, the electrolyte feedstock may be characterized by a copper concentration of less than or about 65.0 g/L. The electrolyte feedstock may be characterized by an acid concentration of greater than or about 90.0 g/L. The acidic solution may be or include sulfuric acid. The methods may include evaporating a portion of the second portion of the electrolyte feedstock while applying the current to the anode of the electrochemical cell. The methods may include adding a second acidic solution to the second compartment. The second acidic solution may be less than or about an amount of evaporated portion of the second portion of the electrolyte feedstock. The methods may include forming an anolyte from the first portion of the electrolyte feedstock in the first compartment. The anolyte may be characterized by a copper concentration of greater than or about 60.0 g/L. The anolyte may be characterized by an acid concentration of less than or about 20.0 g/L. The methods may include forming a catholyte from the second portion of the electrolyte feedstock in the second compartment. The catholyte may be characterized by a copper concentration of greater than or about 60.0 g/L. The catholyte may be characterized by an acid concentration of greater than or about 90.0 g/L. A temperature may be maintained at greater than or about 40° C. The methods may include removing a portion of the acidic solution from the third compartment and replacing with a fresh acidic solution. The fresh acidic solution may maintain an acid concentration in the third compartment. The methods may include adding a third acidic solution to the catholyte to increase an acid concentration in the catholyte. The methods may include adding one or more chemical additives to the catholyte.

Embodiments of the present technology may encompass electroplating methods. The methods may include providing a first portion of an electrolyte feedstock to a first compartment of an electrochemical cell. The methods may include providing a second portion of the electrolyte feedstock to a second compartment of the electrochemical cell. The second compartment and first compartment may be separated by a first membrane. The methods may include providing an acidic solution to a third compartment of the electrochemical cell. The third compartment and second compartment may be separated by a second membrane. The methods may include heating the electrochemical cell to a temperature of greater than or about 40° C. The methods may include applying a current to an anode of the electrochemical cell. The anode of the electrochemical cell may be disposed proximate the first compartment and across from the first membrane. The methods may include forming an anolyte from the first portion of the electrolyte feedstock and a catholyte from the second portion of the electrolyte feedstock. The anolyte and catholyte may be formed simultaneously in the electrochemical cell.

In some embodiments, a portion of the first portion of the electrolyte feedstock in the first compartment may migrate across the first membrane. The methods may include adding deionized water to the first compartment to account for the portion of the first portion of the electrolyte feedstock that migrated the first membrane. The first portion of the electrolyte feedstock may be or include residual anolyte. Forming the anolyte and the catholyte may be completed in less than or about 24 hours.

Embodiments of the present technology may encompass electroplating methods. The methods may include providing a first portion of an electrolyte feedstock to a first compartment of an electrochemical cell. The first compartment may have a volume of greater than or about 200 L. The methods may include providing a second portion of the electrolyte feedstock to a second compartment of the electrochemical cell. The second compartment and first compartment may be separated by a first membrane. The second compartment may have a volume of greater than or about 250 L. The methods may include providing an acidic solution to a third compartment of the electrochemical cell. The third compartment and second compartment may be separated by a second membrane. The third compartment may have a volume of less than or about 50 L. The methods may include heating the electrochemical cell. The methods may include applying a current to an anode of the electrochemical cell. The anode of the electrochemical cell may be disposed proximate the first compartment and across from the first membrane. The methods may include forming an anolyte and a catholyte.

In some embodiments, heating the electrochemical cell may include heating the electrochemical cell to a temperature of greater than or about 40° C. The anolyte and the catholyte may be formed simultaneously in the electrochemical cell. The methods may include replacing portions of the acidic solution in the third compartment to maintain the acid concentration in the acidic solution. The first membrane and the second membrane may include different membrane materials.

Such technology may provide numerous benefits over conventional technology. For example, the present technology may create and maintain electroplating operations at high metal ion concentrations that increase the rates at which metals are electroplated onto substrates. Additionally, the present technology may simultaneously prepare and/or replenish an anolyte and a catholyte for continued electroplating operations. These and other embodiments, along with many of their advantages and features, are described in more detail in conjunction with the below description and attached figures.

BRIEF DESCRIPTION OF THE DRAWINGS

A further understanding of the nature and advantages of the disclosed embodiments may be realized by reference to the remaining portions of the specification and the drawings.

Figure 1:
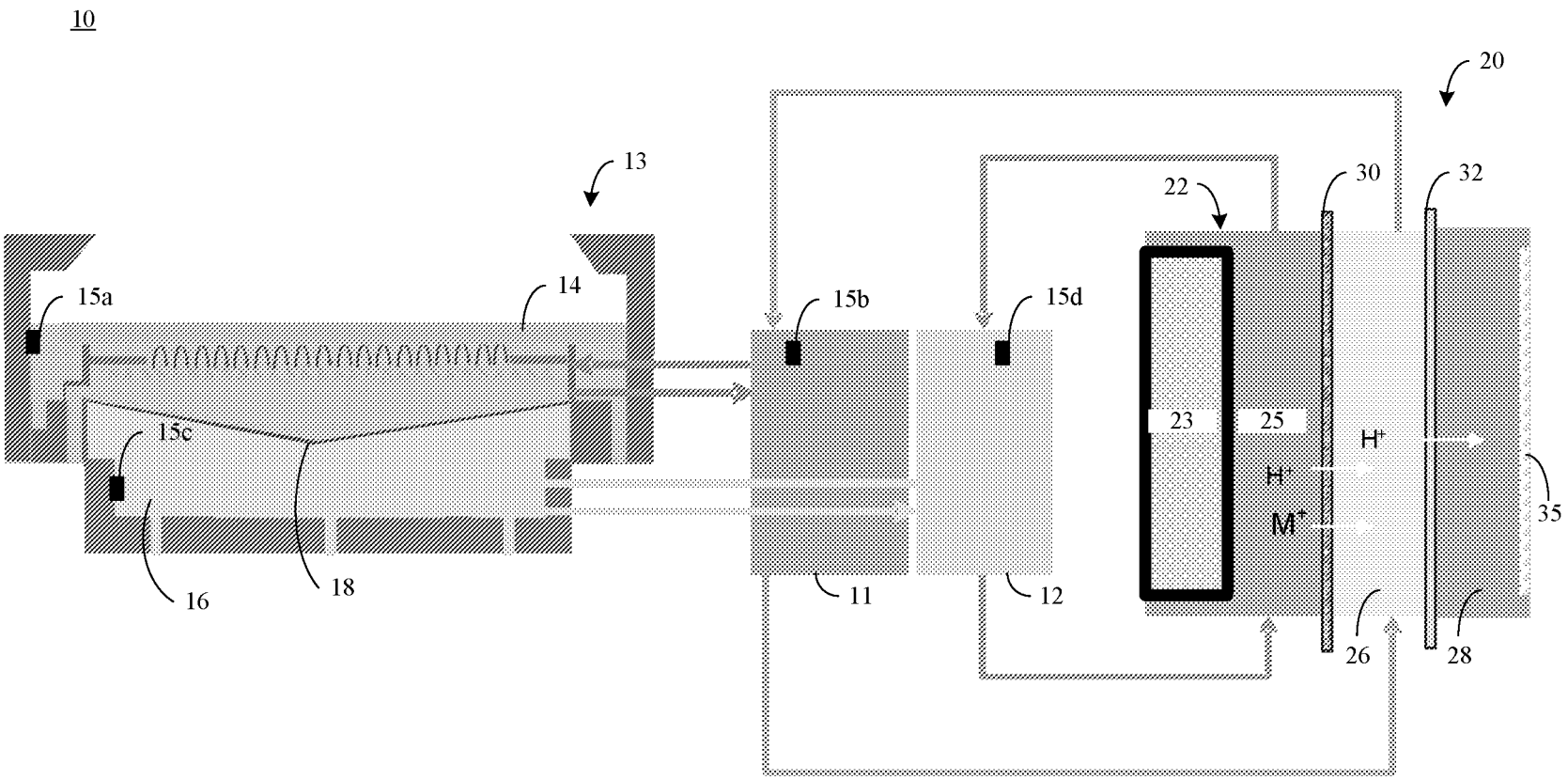
FIG. 1 shows a schematic view of an electroplating processing system according to some embodiments of the present technology.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

In the figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

The metal deposition rate for many electroplated metals increases with higher concentrations of the metal ion in aqueous solution. Conventional techniques to increase the metal ion concentration of an aqueous electroplating solution include adding more starting liquid to the electroplating solution and evaporating some of the water from the solution. Unfortunately, this technique may create problems for electroplating systems that use anolyte and catholyte solutions separated by an ion selective membrane that passes metal ions from the anolyte to the catholyte where metal plating on a substrate surface occurs. Additionally or alternatively, the metal ion concentration may be increased by dissolving a metal-containing material, such as a salt, into the electroplating solution. Unfortunately, this option is not always available within a fab environment.

In electroplating systems that include both an anolyte and catholyte solution, the increase in metal ion concentration normally targets the catholyte because of its direct contact with the electroplating surfaces of the substrate. For most starting liquids, the added metal ions also come with added acid. High acid concentration in the anolyte may reduce the amount of metal ions that are transported across an ion selective membrane separating the anolyte and the catholyte. Accordingly, the metal ion transport may depend on the acid concentration in the anolyte.

The ion selective membrane itself can also contribute to the acidity imbalance by favoring the transport of hydrogen ions over metal ions from anolyte to catholyte. Over time, the ion selective membrane creates a less acidic anolyte that is more concentrated in metal ions. During electroplating, metal ions in the anolyte may transport across the ion selective membrane. Simultaneously, metal ions in the anolyte may be replenished through dissolution of a consumable anode proximate the anolyte. Dissolution of the consumable anode may increase metal ions in the anolyte at a higher rate than metal ions are passed across the ion selective membrane.

Embodiments of the present technology address these problems by creating and maintaining electroplating solutions at high metal ion concentrations that increase the rates at which metals are electroplated onto substrates. The present technology may simultaneously prepare and/or replenish an anolyte and a catholyte for continued electroplating operations. In embodiments, a three-compartment replenishment assembly may simultaneously prepare anolyte and catholyte solution having increased metal ion concentrations. The simultaneous preparation may reduce downtime of the electroplating systems and may increase throughput of electroplated substrates and/or wafers. Furthermore, embodiments of the present technology may use existing hardware, reducing the need for additional equipment.

FIG. 1 shows an exemplary electroplating system 10. In system 10, an electrolyte feedstock may be added directly to the catholyte 14 in electroplating chamber 13 and/or directly to the catholyte in catholyte reservoir 11. In embodiments, when the electrolyte feedstock is added directly to the catholyte 14 in the electroplating chamber and/or directly to the catholyte in catholyte reservoir 11, some residual catholyte may be present in the catholyte reservoir 11, and the addition may adjust the catholyte concentration of a metal ion to an initial concentration of the metal ion. For example, the initial concentration of the metal ion in the catholyte 14 may be less than or about 70.0 g/L, and may be less than or about 67.5 g/L, less than or about 62.5 g/L, less than or about 60.0 g/L, less than or about 57.5 g/L, less than or about 55.0 g/L, less than or about 52.5 g/L, less than or about 50.0 g/L, or less.

In some embodiments, the system 100 may be substantially drained of catholyte prior to the addition of the electrolyte feedstock and the addition represents the filling or refilling of the system's catholyte at the beginning of an electroplating method. In these embodiments, the concentration of the metal ion in the catholyte 14 is the metal ion concentration of the electrolyte feedstock. In additional embodiments, as previously discussed, the electrolyte feedstock may be added to system 10 that already contains catholyte. Depending on the metal ion concentration of the preexisting catholyte in system 10, the addition of the electrolyte feedstock may decrease the metal ion concentration to reach the first metal ion concentration in the catholyte.

Similarly, electrolyte feedstock may be added directly to the anolyte 16 in electroplating chamber 13 and/or directly to the anolyte in anolyte reservoir 12. In embodiments, the addition of the electrolyte feedstock may adjust the anolyte concentration of a metal ion to an initial concentration of the metal ion that is substantially the same as the metal ion concentration in the electrolyte feedstock. In further embodiments, the initial concentration of the metal ion in the anolyte 16 may be less than or about 70.0 g/L, and may be less than or about 67.5 g/L, less than or about 62.5 g/L, less than or about 60.0 g/L, less than or about 57.5 g/L, less than or about 55.0 g/L, less than or about 52.5 g/L, less than or about 50.0 g/L, or less.

In embodiments, the initial concentration of the metal ion in the catholyte 14 may be the same as the initial concentration of the metal ion in the anolyte 16 as both the electrolyte feedstock used in both the catholyte 14 and the anolyte 16 may be a virgin makeup solution (VMS). For example, the VMS may be characterized by a metal ion concentration, such as a copper ion concentration, of about 55.0 g/L and by an acid concentration of about 100 g/L. While both the electrolyte feedstock for the catholyte 14 and the anolyte 16 may be the same material, such as VMS, with the same metal ion concentration and the same acid concentration, the electrolyte feedstock for the catholyte 14 and the electrolyte feedstock for the anolyte 16 may also have different metal ion concentration and/or acid concentration. As previously discussed, some residual catholyte and/or anolyte may be present in the electroplating chamber 13 which may alter the metal ion concentration and/or acid concentration.

In some embodiments, the system 10 may be substantially drained of anolyte prior to the addition of the electrolyte feedstock and the addition represents the filling or refilling of the system's anolyte at the beginning of an electroplating method. In these embodiments, the concentration of the metal ion in the anolyte 16 is the metal ion concentration of the electrolyte feedstock. In additional embodiments, the electrolyte feedstock may be added to system 10 that already contains anolyte. In these embodiments, the addition adjusts the concentration of the metal ion in anolyte 16 or anolyte reservoir 12 closer to the metal ion concentration in the electrolyte feedstock. Depending on the metal ion concentration of the preexisting anolyte in system 10, the addition of the electrolyte feedstock may decrease the metal ion concentration to reach the first metal ion concentration in the anolyte.

The metal ions may refer to the metal ions capable of being electroplated as a metal on a substrate that is in fluid contact with the catholyte. It should be appreciated that the electrolyte feedstock, the catholyte 14, and the anolyte 16 may include other metal ions (e.g., ions of alkali metals and alkaline earth metals) that are not counted in the metal ion concentration because they are not electroplated as metals on the substrate. The metal ions may include copper ions, tin ions, and nickel ions, among other types of metal ions. These metal ions may be electroplated as metal layers of copper, tin, and nickel, respectively, on the surface of the substrate. The metal ions may be dissolved ions of a metal salt that is at least partially soluble in water. The metal salts may include copper sulfate ($CuSO_4$) and copper chloride ($CuCl_2$) among other metal salts. The catholyte and anolyte may be aqueous solutions or mixtures that include the metal ions. The catholyte may include, in addition to the metal ions, one or more additives such as a suppressor, an accelerator, and a leveler, among other additives. The anolyte may lack at least one additive found in the catholyte.

In embodiments, the metal ion concentration may be measured by a metal ion sensor 105*a* positioned in the electroplating chamber 13 to be in fluid contact with the catholyte 14. During the portion of an electroplating operation when the metal ions are plating on the substrate, the metal ion concentration in catholyte 14 drops. The magnitude of the drop depends on a number of factors, including the electroplated surface area of the substrate (or substrates), the volume of catholyte, the amount of electric current passing through the electrodes of system 10, and the rate of metal ion transport between the anolyte and catholyte, among other factors. The rate of metal ion transport is further influenced by a number of factors including the absolute and relative metal ion concentration in the catholyte and anolyte, as well as the acidity (pH) of the catholyte and anolyte as well as the difference in acidity between the catholyte and anolyte. Primarily, the acid concentration in the anolyte may determine the rate of metal ion transport across the membrane.

In embodiments, the measurement of the metal ion concentration in catholyte 14 may be continuous, or may be done at intervals before, during, and after the electroplating of metal onto a substrate. In further embodiments, the measurement of the metal ion concentration in the catholyte 14 may measure a reduction in the metal ion concentration from the first metal ion concentration immediately following the addition of the electrolyte feedstock to a second metal ion concentration that is less than the first metal ion concentration. When a measurement finds the metal ion concentration has decreased to the second metal ion concentration or lower, a signal may be sent from sensor 15*a* to increase the metal ion concentration in the catholyte 14.

It should be appreciated that metal ion concentration measurements can be taken at locations in system 10 other than the catholyte 14 in the electroplating chamber 13. In embodiments, the metal ion concentration may be measured in the catholyte held in catholyte reservoir 11 by a metal ion sensor 15*b* in contact with the catholyte. The measurement of the metal ion concentration in the catholyte held in the catholyte reservoir 110 may be less variable than measurements of the metal ion concentration in the catholyte 14 held in the electroplating chamber 13. Changes in the metal ion concentration may be measured more rapidly in the catholyte 14 than the catholyte held in catholyte reservoir 11. The metal ion measurements may be made in both the catholyte 14 held in the electroplating chamber 13 and the catholyte reservoir 11.

In embodiments, the pH may be measured by sensor 15*a* that is also capable of measuring the metal ion concentration in the catholyte 14. In further embodiments, the pH may be measured by a sensor (not shown) that is independent of sensor 15*a*, such as a dedicated pH meter. In more embodiments, the catholyte pH measured may further include generating a pH signal from the pH sensor that is in electronic communication with a logic processor (not shown). When the sensor indicates that the catholyte pH is above or below a threshold level, the logic processor may generate a signal to perform one or more operations to increase the catholyte pH. The catholyte pH that causes the logic processor to generate the signal to start the one or more pH decreasing operations may be greater than or about 0.0, greater than or about 0.1, greater than or about 0.2, greater than or about 0.3, greater than or about 0.4, greater than or about 0.5, greater than or about 0.6, greater than or about 0.7, greater than or about 0.8, greater than or about 0.9, greater than or about 1.0, or more. The catholyte pH that causes the logic processor to generate the signal to start the one or more pH increasing operations may be less than or about 0.5, less than or about 0.4, less than or about 0.3, less than or about 0.2, less than or about 0.1, less than or about 0.0, less than or about −0.1, less than or about −0.2, less than or about −0.3, less than or about −0.4, less than or about −0.5, less than or about −0.6, or less.

In system 10, the anolyte pH may be measured by one or more sensors 15*c* and 15*d* in contact with the anolyte 16 in the electroplating chamber 13, and the anolyte in anolyte reservoir 12, respectively. When sensor 15*c* or 15*d* indicates that the anolyte pH is at or above a threshold level, the logic processor may generate a signal to perform one or more operations to decrease the anolyte pH. The anolyte pH that causes the logic processor to generate the signal to start the one or more pH decreasing operations may be greater than or about 3.0, greater than or about 3.1, greater than or about 3.2, greater than or about 3.3, greater than or about 3.4, greater than or about 3.5, greater than or about 3.7, greater than or about 3.8, greater than or about 3.9, greater than or about 4.0, or more.

As noted above, electroplating involves the removal of metal ions from the catholyte in fluid contact with the substrate as the ions are reduced to a metal layer on the substrate. The removal of the electroplated metal ions from the catholyte causes the metal ion concentration in the catholyte to decrease. In electroplating systems according to embodiments of the present technology, like system 10, the metal ions in the catholyte are replenished in large part by the migration of metal ions from the anolyte 16 though an ion selective membrane 18 that selectively passes the cations while blocking the migration of other components of the anolyte and catholyte. In embodiments, these other components can include catholyte additives such as suppressors (e.g., polyethylene glycols), accelerators (e.g., bis-(3-sulfopropyl)-disulfide), and levelers (e.g., Janus Green B dye) that facilitate the electroplating of a uniform metal layer on the substrate. The ion selective membrane 18 may prevent the additives from traversing the membrane with the cations and, for example, forming a film on an electrode with opposite charge (e.g., negatively-charged additives forming a film on the anode).

In many embodiments, the migration of metal ions through the ion selective membrane 108 is slower than the migration of hydrogen ions ($H^+$) through the membrane. Over time, the replenishment of electroplating metal ions in the catholyte 14 with metal ions in the anolyte 16 increases a concentration gradient between the catholyte and anolyte. It also increases the catholyte acid concentration. Alternatively, catholyte acid concentration may not increase if more protons are carried across second membrane into third compartment than are carried across first membrane from first compartment.

In embodiments, electroplating system 10 may include additional components that facilitate electroplating operations. In additional embodiments, electroplating system 10 may include a replenishing assembly 20 that provides additional metal ions to the anolyte and/or catholyte during electroplating operations. The replenishing assembly 20 may include an anolyte chamber 22, a catholyte chamber 26, and a third chamber 28 in contact with a cathode 35. The anolyte chamber 22 and the catholyte chamber 26 may be fluidly separated by a first ion selective membrane 30 that is operable to pass both metal ions and hydrogen ions from the anolyte chamber 22 to the catholyte chamber 26. The first ion selective membrane 30 may slow or block the transfer of additives between the catholyte chamber 26 and the anolyte chamber 22. The catholyte chamber 26 and the third chamber 28 may be fluidly separated by a second cation selective membrane 32 that may be operable to pass hydrogen ions from the catholyte chamber 26 to the third chamber 28. In embodiments, the second cation selective membrane 32 may be the same material as the first ion selective membrane 32. Alternatively, the membranes may be different, and, for example, the second cation selective membrane 32 may be a monovalent membrane that selectively transports H+ ions. However, monovalent membrane that selectively transports H+ ions may still allow some amount of Cu++ to be transported across the membrane. The second ion selective membrane 32 may slow or block the migration of metal ions and additives from the catholyte chamber 26 to the third chamber 28.

In embodiments, the anolyte chamber 22 may include a first compartment 23 to hold anode material that generates additional metal ions for the anolyte contained in a second compartment 25 that is in fluid contact with the anode material. The anode material in first compartment 23 may also act as an anode that is electrically connected to the cathode 35 that is in fluid contact with the catholyte in the third chamber 28. A portion of the metal ions generated by the anode material may be added to the catholyte in the catholyte reservoir 11 and/or the anolyte in the anolyte reservoir 12. The additional metal ions help maintain the concentration of metal ions in the catholyte and the anolyte in the electroplating chamber 13 and reservoirs 11 and 12 during electroplating operations.

Figure 2:
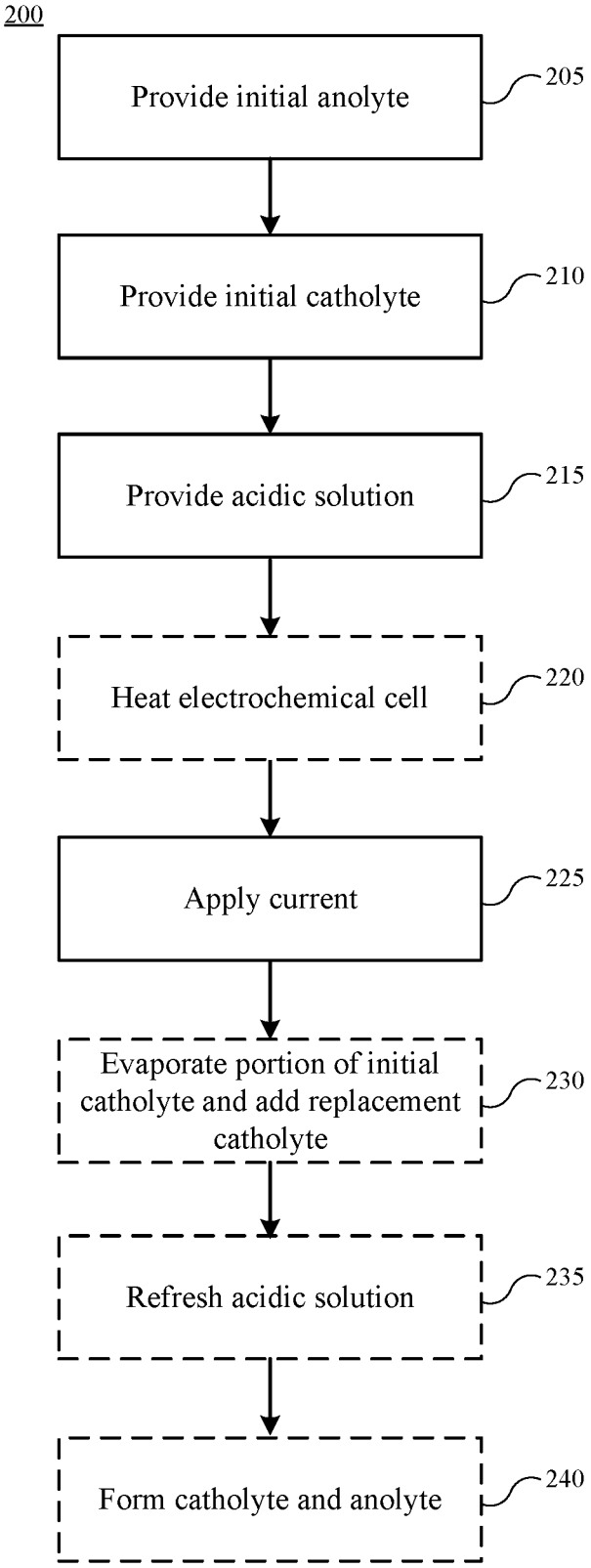
FIG. 2 shows exemplary operations in a method of operating an electroplating system according to some embodiments of the present technology.
Figure 3:
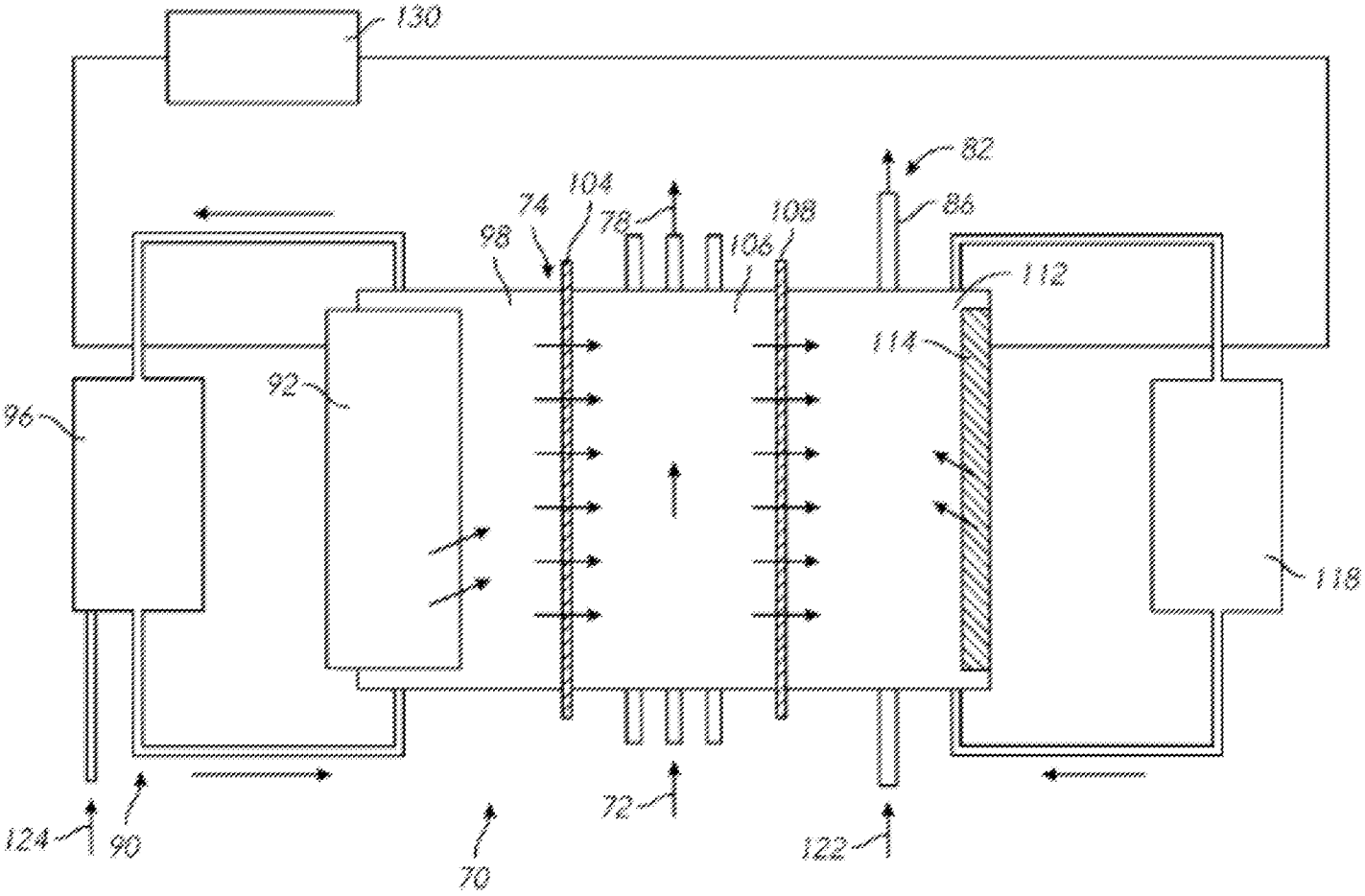
FIG. 3 shows a schematic view of a replenish assembly according to some embodiments of the present technology.

FIG. 2 shows exemplary operations in a method 200 of operating an electroplating system according to some embodiments of the present technology. However, it is contemplated that the operations shown in FIG. 2 are just one embodiment and that the operations may be performed in any order or sequence. The method may be performed in a variety of processing systems, including the electroplating systems according to embodiments of the present technology described below, which include exemplary replenish assembly 74 shown in FIG. 3. The figure shows an enlarged schematic view of the replenish assembly 74 as operational components that may be applicable to any number of specific replenish assembly configurations.

The method may include providing a replenish assembly anolyte (e.g., electrolyte feedstock) to a replenish assembly anolyte compartment 98, which may be a first compartment of the replenish assembly 74 at operation 205. The first compartment may have a volume of greater than or about 200 L. Electrolyte feedstock in the anolyte compartment 98 may be or include residual anolyte from previous electroplating operations. The electrolyte feedstock in the anolyte compartment may be characterized by an initial concentration of a metal ion. The anolyte may circulate within the replenish assembly 74 through a replenish assembly anolyte loop 90 including anolyte compartment 98, and optionally a replenish assembly anolyte tank 96. The method may include providing a replenish assembly catholyte (e.g., electrolyte feedstock) to a replenish assembly catholyte compartment 106, which may be a second compartment of the replenish assembly 74 at operation 210. The second compartment may have a volume of greater than or about 250 L, and may have a volume of greater than or about 300 L, greater than or about 350 L, or more. The electrolyte feedstock in the catholyte compartment 98 may be characterized by an initial concentration of the metal ion. A catholyte return line 72 may be connected to one side of the catholyte compartment 106 and a catholyte supply line 78 may be connected to the other side of the catholyte compartment 106, which may allow circulation of catholyte through the catholyte compartment 106. Alternately, the catholyte flow loop through the replenish assembly 74 may be a separate flow circuit with the catholyte tank (e.g., catholyte tank 110).

The electrolyte feedstock concentration of the metal ion may be characterized by a copper concentration of less than or about 80.0 g/L, such as less than or about 87.5 g/L, less than or about 85.0 g/L, less than or about 82.5 g/L, less than or about 80.0 g/L, less than or about 77.5 g/L, less than or about 75.0 g/L, less than or about 72.5 g/L, less than or about 70.0 g/L, or less. The electrolyte feedstock may be characterized by an acid concentration of greater than or about 90.0 g/L, such as greater than or about 92.5 g/L, greater than or about 95.0 g/L, greater than or about 97.5 g/L, greater than or about 100.0 g/L, or more.

In some embodiments, such as for copper plating, the replenish assembly anolyte may be a copper sulfate electrolyte, although it is to be understood that the system may be used for any number of electroplating operations utilizing chemistries and materials suitable for those operations. The anolyte replenish assembly within the replenish assembly 74 may not require a recirculation loop and may include just an anolyte compartment 98. A gas sparger, for example a nitrogen gas sparger, can provide agitation for the replenish assembly without the complication of a recirculation loop requiring plumbing and a pump. Again referring to a copper plating system, as a non-limiting example, if a low acid electrolyte or anolyte is used, when current is passed across the replenish assembly, Cu' ions may transport or move across the membrane into the catholyte, rather than protons. Gas sparging may also reduce oxidation of bulk copper material.

A deionized water supply line 124 may supply make-up deionized water into the replenish assembly anolyte tank 96 or the compartment 98. Bulk plating material 92, such as copper pellets for example, may be provided in the replenish assembly anolyte compartment 98 and provide the material which may be plated onto the wafer 50. A pump may circulate replenish assembly anolyte through the replenish assembly anolyte compartment 98. The replenish assembly anolyte may be entirely separate from the anolyte provided to the anodes 40 and/or 42. Additionally, in some embodiments, an anolyte compartment 98 may be used without any replenish assembly anolyte loop 90. A gas sparger, for example, or some other pumping system can provide agitation for the anolyte compartment 98 without using a replenish assembly anolyte loop. For example, some embodiments of anolyte compartments, or first compartments, may include an anolyte replenish tank, or may simply circulate anolyte within the compartment, or within two sections of the compartment as will be described further below.

Within the replenish assembly 74, a first cation membrane 104 may be positioned between the anolyte compartment 98 and a catholyte compartment 106, to separate the replenish assembly anolyte from the catholyte. The first cation membrane 104 may allow metal ions and water to pass through the replenish assembly anolyte compartment 98 into the catholyte in the catholyte compartment 106, while otherwise providing a barrier between the replenish assembly anolyte and the catholyte. Deionized water may added to the catholyte to replenish water lost to evaporation, but more commonly water evaporation can be enhanced to evaporate the water entering into the catholyte through electro-osmosis from the anolyte replenish assembly. An evaporator may also be included to facilitate removal of excess water.

The flow of metal ions into the catholyte may replenish the concentration of metal ions in the catholyte. In embodiments, as metal ions in the catholyte are deposited onto the wafer 50 to form the metal layer on the wafer 50, they may be replaced with metal ions originating from the bulk plating material 92 moving through the replenish assembly anolyte and the first membrane 104 into the catholyte flowing through the catholyte compartment 106 of the replenish assembly 74. In further embodiments, metal ions are added to the catholyte by directly transporting a portion of the anolyte to the catholyte through a conduit that bypasses the ion membranes.

The method 200 may include providing an acidic solution to a third compartment 112, which may be a third compartment of the replenish assembly 74 at operation 215. The third compartment may have a volume of less than or about 50 L. Together, the first compartment, the second compartment, and the third compartment of the replenish assembly 74 may form an electrochemical cell. The acidic solution in the third compartment 112 may optionally circulate through a replenish assembly tank 118, with deionized water and sulfuric acid added to the replenish assembly electrolyte via an inlet 122. The third compartment 112 electrolyte may include, for example, deionized water with 1-10% sulfuric acid. The acidic solution may be characterized by an initial pH.

Within the replenish assembly 74, a second cation membrane 108 may be positioned between the catholyte compartment 106 and the third compartment 112, to separate the catholyte from the acidic solution. The second cation membrane 108 may allow protons (i.e., hydrogen ions) to pass through from the catholyte in the catholyte compartment 106 into the acidic solution in the third compartment 112, while limiting the amount of metal ions that pass through the membrane, which may then plate out on the inert cathode. One function of third compartment 112 may be to complete the electrical circuit for the replenish assembly in a way that does not plate metal out onto a cathode 114 disposed in the third compartment 112. The third compartment 112 may be used with or without an extra tank or circulation loop. The high acid electrolyte or catholyte bath in catholyte compartment 106 may ensure that a high portion of the current crossing membrane 108 is protons rather than metal ions, so that the cathode reaction on the inert cathode 114 is mostly hydrogen evolution. In this way, the current within the replenish assembly 74 replenishes the copper within the catholyte while preventing it from being lost through membrane 108. The second cation membrane 108 may be the same material or a different material as the first cation membrane 104.

The cathode 114, such as an inert cathode, may be located in the third compartment 112 opposite from the second cation membrane 108. The negative or cathode of a power supply 130, such as a DC power supply, may be electrically connected to the cathode 114. The positive or anode of the power supply 130 may be electrically connected to the bulk plating material 92 or metal in the replenish assembly anolyte compartment 98 applying or creating a voltage differential across the replenish assembly 74. The inert cathode 114 may be a platinum or platinum-clad wire or plate. The second ionic membrane 108 may help to retain copper ions in the second compartment. Additionally, the second ionic membrane 108 may be configured to particularly maintain $Cu^{2+}$ within the catholyte. For example, in some embodiments, the second ionic membrane may be a monovalent membrane, which may further limit passage of copper through the membrane.

In some embodiments, prior to applying a current to the replenish assembly 74, the method 200 may include heating the replenish assembly 74 at optional operation 220. A temperature in the electrochemical cell of replenish assembly 74 may be maintained at greater than or about 40° C., greater than or about 45° C., greater than or about 50° C., or more. At operation 225, a current may be applied to the anode or bulk plating material 92. In embodiments, operation 225 may include applying the current for a fixed time in order to deliver a desired charge. Application of the current to the anode may increase the initial concentration of the metal ion in the electrolyte feedstock in the second compartment of the electrochemical cell while concentration of the metal ion in the third compartment may be unchanged or relatively stable. For example, a concentration of the metal ion in the third compartment of the electrochemical cell may change by less than or about 5%, and may change by less than or about 4%, less than or about 3%, less than or about 2%, less than or about 1%, less than or about 0.5%, or less.

As previously discussed, water may evaporate from the catholyte in the catholyte compartment 106 during method 200, such as during optional operation 230, which may be intentional to compensate for water transport across the first ion selective membrane 30 and to concentrate the catholyte. The evaporation may result in concentration of the catholyte in the catholyte compartment 106. The evaporation and resultant concentration may increase the metal ion concentration and the acid concentration compared to the electrolyte feedstock, such as the VMS. In embodiments, acid in the second compartment may drop over time because more H+ ions move across second membrane 32 than come in through first membrane 30. This trend may require adding an acidic solution to second compartment to compensate for the reduction in H+ ions. In embodiments, the acid solution may be characterized by an acid concentration of greater than or about 200 g/L, greater than or about 205 g/L, greater than or about 210 g/L, greater than or about 215 g/L, greater than or about 220 g/L, or more. Additionally, at optional operation 230, which may be performed subsequent to or simultaneously with operation 225, the method 200 may include adding an acidic solution to the catholyte compartment 106. The acidic solution may be less than or about an amount of evaporated portion of the electrolyte feedstock. In embodiments, the acidic solution may be provided with water, such as deionized water. Further, as previously discussed, method 200 may include adding one or more additives to the catholyte.

In order to maintain acid concentration in the third compartment, the method 200 may include periodically refreshing at least a portion of the acidic solution in the third compartment. For example, at optional operation 235, which may be performed subsequent to or simultaneously with operations 225 and/or 230, the method 200 may include removing a portion of the acidic solution from the third compartment and replacing with a fresh acidic solution. This bleed and feed operation may maintain the acid concentration and pH in the acidic solution in the third compartment 112.

The method may include forming an anolyte and forming a catholyte at optional operation 240. The anolyte may be formed in the first compartment and the catholyte may be formed in the second compartment. The anolyte may be diluted from the electrolyte feedstock, such as the VMS solution. The catholyte may be concentrated via evaporation and, optionally, acid may be added during and/or after concentration. The anolyte may be characterized by a metal ion concentration of greater than or about 60.0 g/L and an acid concentration of less than or about 20.0 g/L. For example, the anolyte may be characterized by a metal concentration of greater than or about 62.5 g/L, greater than or about 65.0 g/L, greater than or about 66.0 g/L, greater than or about 66.0 g/L, greater than or about 67.0 g/L, greater than or about 68.0 g/L, greater than or about 69.5 g/L, greater than or about 70.0 g/L, greater than or about 72.5 g/L, greater than or about 75.0 g/L, greater than or about 77.5 g/L, greater than or about 80.0 g/L, or more. Furthermore, the anolyte may be characterized by an acid concentration of less than or about 20.0 g/L, less than or about 15.0 g/L, less than or about 12.5 g/L, less than or about 10.0 g/L, less than or about 9.0 g/L, less than or about 8.0 g/L, less than or about 7.0 g/L, less than or about 6.0 g/L, less than or about 5.0 g/L, less than or about 4.0 g/L, less than or about 3.0 g/L, less than or about 2.0 g/L, less than or about 1.0 g/L, or less. The catholyte may be characterized by a metal ion concentration of greater than or about greater than or about 50.0 g/L, and may be increased to greater than or about 62.5 g/L, greater than or about 65.0 g/L, greater than or about 66.0 g/L, greater than or about 66.0 g/L, greater than or about 67.0 g/L, greater than or about 68.0 g/L, greater than or about 69.5 g/L, greater than or about 70.0 g/L, greater than or about 72.5 g/L, greater than or about 75.0 g/L, greater than or about 77.5 g/L, greater than or about 80.0 g/L, or more, or more. The catholyte may be characterized by an acid concentration of greater than or about 90.0 g/L, such as greater than or about 92.5 g/L, greater than or about 95.0 g/L, greater than or about 97.5 g/L, greater than or about 100.0 g/L, greater than or about 102.5 g/L, greater than or about 105.0 g/L, greater than or about 107.5 g/L, greater than or about 110.0 g/L, greater than or about 112.5 g/L, or more. In embodiments, operation 240 may include adding a second acidic solution to the catholyte to increase the acid concentration. In embodiments, the metal ion concentration and acid concentration of the electrolyte feedstock, such as the VMS, may be selected to determine the metal ion concentration and acid concentration of the anolyte and the catholyte.

The anolyte and the catholyte may be formed in less than or about 24 hours, such as less than or about 23 hours, less than or about 22 hours, less than or about 21 hours, less than or about 20 hours, or less. Furthermore, embodiments of the present technology permit a simultaneous formation of the anolyte and the catholyte, further expediting the preparation of the solutions.

Embodiments of the present technology allow electroplating operations to be performed at increased metal ion concentrations in the catholyte over extended periods of time. The increased metal ion concentration increases the rate at which metal is deposited on a substrate during electroplating operations, increasing the throughput of substrates through the electroplating systems. In embodiments, the increased metal ion concentration is maintained for extended periods by adding a portion of the electroplating system's anolyte directly to the catholyte. The metal-ion-rich anolyte increases the concentration of metal ions in the catholyte that are being depleted by the electroplating operation. The low acidity anolyte may also help to lower the catholyte acid concentration. The addition of a portion of the anolyte directly to the catholyte permits electroplating operations at metal ion concentrations that can exceed the metal ion concentration in a metal-ion-containing starting solution and maintain those high concentration levels even as the metal ions are being removed from the catholyte during an electroplating operation.

In the preceding description, for the purposes of explanation, numerous details have been set forth in order to provide an understanding of various embodiments of the present technology. It will be apparent to one skilled in the art, however, that certain embodiments may be practiced without some of these details, or with additional details.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included. Where multiple values are provided in a list, any range encompassing or based on any of those values is similarly specifically disclosed.

As used herein and in the appended claims, the singular forms "a", "an", and "the" include plural references unless the context clearly dictates otherwise. Thus, for example, reference to "a metal ion" includes a plurality of such metal ions, and reference to "the first compartment" includes reference to one or more compartments and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. An electroplating method comprising:

providing a first portion of an electrolyte feedstock to a first compartment of an electrochemical cell, wherein the first portion of the electrolyte feedstock is characterized by an initial metal ion concentration and an initial acid concentration;

providing a second portion of the electrolyte feedstock to a second compartment of the electrochemical cell, wherein the second portion of the electrolyte feedstock is characterized by an initial metal ion concentration, and wherein the second compartment and first compartment are separated by a first membrane;

providing an acidic solution to a third compartment of the electrochemical cell, wherein the third compartment and second compartment are separated by a second membrane, and wherein the acidic solution is characterized by an initial acid concentration;

applying a current to the electrochemical cell, wherein an anode of the electrochemical cell is disposed proximate the first compartment and across from the first membrane, and a cathode of the electrochemical cell is disposed proximate the third compartment and across from the second membrane, wherein applying the current forms an anolyte from the first portion of the electrolyte feedstock in the first compartment; and providing at least a portion of the anolyte to an anode chamber of an electroplating chamber for electroplating.

2. The electroplating method of claim 1, wherein the electrolyte feedstock is characterized by a copper concentration of less than or about 65.0 g/L.

3. The electroplating method of claim 1, wherein the electrolyte feedstock is characterized by an acid concentration of greater than or about 90.0 g/L.

4. The electroplating method of claim 1, wherein the acidic solution comprises sulfuric acid.

5. The electroplating method of claim 1, further comprising:

evaporating a portion of the second portion of the electrolyte feedstock while applying the current to the anode of the electrochemical cell.

6. The electroplating method of claim 5, further comprising:

adding a second acidic solution to the second compartment, wherein the second acidic solution is less than or about an amount of evaporated portion of the second portion of the electrolyte feedstock.

7. The electroplating method of claim 1, wherein the anolyte is characterized by:

a copper concentration of greater than or about 60.0 g/L; and an acid concentration of less than or about 20.0 g/L.

8. The electroplating method of claim 1, wherein:

forming a catholyte from the second portion of the electrolyte feedstock in the second compartment, wherein the catholyte is characterized by:

a copper concentration of greater than or about 60.0 g/L; and an acid concentration of greater than or about 90.0 g/L.

9. The electroplating method of claim 1, wherein a temperature is maintained at greater than or about 40° C.

10. The electroplating method of claim 1, further comprising:

removing a portion of the acidic solution from the second compartment and replacing with a fresh acidic solution, wherein the fresh acidic solution maintains an acid concentration in the second compartment.

11. The electroplating method of claim 2, further comprising:

adding a third acidic solution to the catholyte to increase the acid concentration in the catholyte.

12. The electroplating method of claim 8, further comprising:

adding one or more chemical additives to the catholyte.

13. An electroplating method comprising:

providing a first portion of an electrolyte feedstock to a first compartment of an electrochemical cell;

providing a second portion of the electrolyte feedstock to a second compartment of the electrochemical cell, wherein the second compartment and first compartment are separated by a first membrane;

providing an acidic solution to a third compartment of the electrochemical cell, wherein the third compartment and second compartment are separated by a second membrane;

heating the electrochemical cell to a temperature of greater than or about 40° C.;

applying a current to the electrochemical cell, wherein an anode of the electrochemical cell is disposed proximate the first compartment and across from the first membrane, and a cathode of the electrochemical cell is disposed proximate the third compartment and across from the second membrane;

forming an anolyte from the first portion of the electrolyte feedstock and a catholyte from the second portion of the electrolyte feedstock, wherein the anolyte and catholyte are formed simultaneously in the electrochemical cell; and providing at least a portion of the anolyte to an anode chamber of an electroplating chamber for electroplating.

14. The electroplating method of claim 13, wherein:

a portion of the first portion of the electrolyte feedstock in the first compartment migrates across the first membrane; and the method further comprises adding deionized water to the first compartment to account for the portion of the first portion of the electrolyte feedstock that migrated the first membrane.

15. The electroplating method of claim 13, wherein the first portion of the electrolyte feedstock comprises residual anolyte.

16. The electroplating method of claim 15, wherein forming the anolyte and the catholyte is completed in less than or about 24 hours.

17. An electroplating method comprising:

providing a first portion of an electrolyte feedstock to a first compartment of an electrochemical cell, wherein the first compartment comprises a volume of greater than or about 200 L;

providing a second portion of the electrolyte feedstock to a second compartment of the electrochemical cell, wherein the second compartment and first compartment are separated by a first membrane, and wherein the second compartment comprises a volume of greater than or about 250 L;

providing an acidic solution to a third compartment of the electrochemical cell, wherein the third compartment and second compartment are separated by a second membrane, and wherein the third compartment comprises a volume of less than or about 50 L;

heating the electrochemical cell;

applying a current to the electrochemical cell, wherein an anode of the electrochemical cell is disposed proximate the first compartment and across from the first membrane, and a cathode of the electrochemical cell is disposed proximate the third compartment and across from the second membrane;

forming an anolyte and a catholyte; and providing at least a portion of the anolyte to an anode chamber of an electroplating chamber for electroplating.

18. The electroplating method of claim 17, wherein heating the electrochemical cell comprises heating the electrochemical cell to a temperature of greater than or about 40° C.

19. The electroplating method of claim 17, wherein the anolyte and the catholyte are formed simultaneously in the electrochemical cell.

20. The electroplating method of claim 17, further comprising:

replacing portions of the acidic solution in the third compartment to maintain an acid concentration in the acidic solution.

21. The electroplating method of claim 17, wherein the first membrane and the second membrane comprise different membrane materials.

* * * * *